United States Patent [19]

Winkelman

[11] Patent Number: 4,721,287

[45] Date of Patent: Jan. 26, 1988

[54] SLEEVE FOR BLOWING SOLID MATERIALS INTO A MOLTEN METAL BATH AND METHOD FOR USE THEREOF

[75] Inventor: Manfred Winkelman, Krefeld, Fed. Rep. of Germany

[73] Assignee: Didier-Werke AG, Wiesbaden, Fed. Rep. of Germany

[21] Appl. No.: 831,137

[22] Filed: Feb. 19, 1986

[30] Foreign Application Priority Data

Feb. 20, 1985 [DE] Fed. Rep. of Germany ..... 3505821

[51] Int. Cl.[4] ..... C21C 5/48

[52] U.S. Cl. ..... 266/47; 266/270

[58] Field of Search ..... 266/265, 266, 270, 47

[56] References Cited

U.S. PATENT DOCUMENTS 3,395,910 8/1968 Holmes ..... 266/270

4,331,471 5/1982 Langenfeld et al. ..... 266/265

4,522,376 6/1985 Langenfeld ..... 266/47

FOREIGN PATENT DOCUMENTS 2503672 9/1975 Fed. Rep. of Germany ..... 266/270

*Primary Examiner*—L. Dewayne Rutledge

*Assistant Examiner*—Robert L. McDowell

*Attorney, Agent, or Firm*—Nils H. Ljungman

[57] ABSTRACT

The invention relates to a sleeve for blowing solid materials into molten metal baths, specifically molten steel baths, through the wall of a ladle containing the molten metal bath. To improve the characteristics of such a sleeve, the invention proposes that a forward sleeve section, facing the molten metal bath, be made of an insulating material with lower thermal conductivity than that of the material of the middle and rear sleeve section.

26 Claims, 1 Drawing Figure

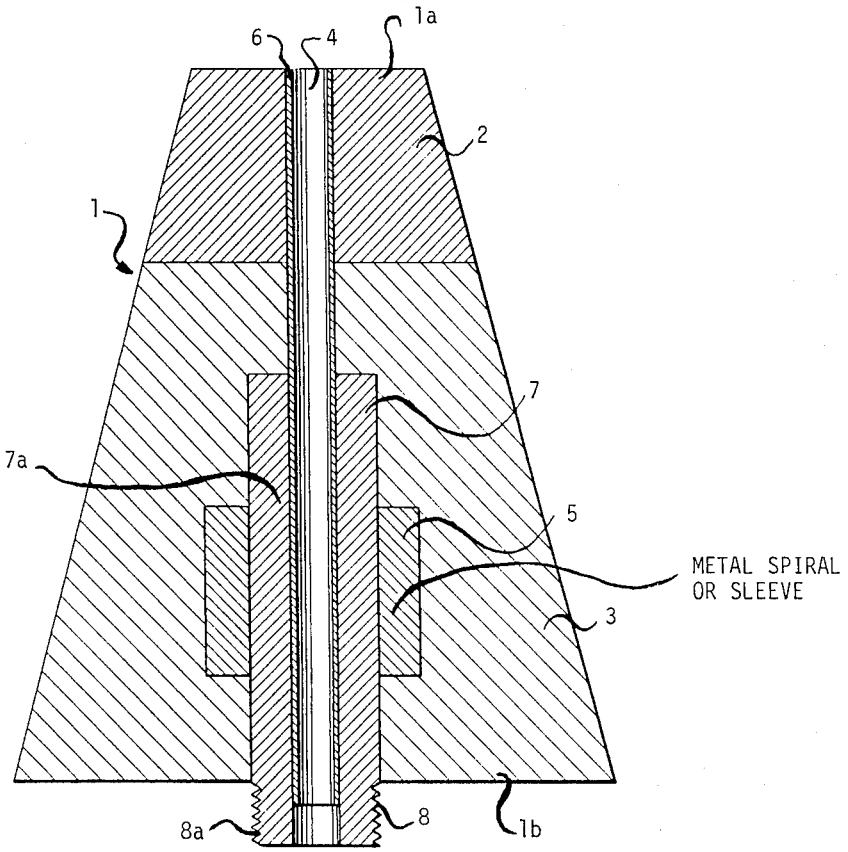
1a
6
4
2
1
7
7a
5
METAL SPIRAL
OR SLEEVE
3
8a
8
1b

SLEEVE FOR BLOWING SOLID MATERIALS INTO A MOLTEN METAL BATH AND METHOD FOR USE THEREOF

CROSS REFERENCE TO CO-PENDING APPLICATION

Co-pending application Ser. No. 665,758 filed on Oct. 29, 1984, entitled "Molten Metal Immersion Pouring Spout", which corresponds to Federal Republic of Germany Patent Application No. P 33 39 586.1, filed on Nov. 2, 1983, is assigned to the same assignee as the instant application and is incorporated herein by reference as if the text thereof was fully set forth herein.

BACKGROUND OF THE INVENTION

1. Field of the Invention

The invention relates to a sleeve for blowing solid materials into molten metal baths, specifically molten steel baths, through the wall of a ladle containing the molten metal bath.

2. Description of the Prior Art

In such sleeves for blowing solid particles, such as Aluminum (Al), Calcium Silicide (CaSi), Calcium Oxide (CaO), Calcium Fluoride ($CaF_2$), Carbon (C) and similar materials, into the bottom or side wall of a ladle containing a molten steel bath, there is a danger of a freezing of the molten material on the bottom or on the wall of the ladle, which freezing can interfere with the blowing of the solid materials.

Some examples of inlet arrangements are found in U.S. Pat. No. 4,522,376, issued June 11, 1985, and U.S. Pat. No. 4,331,471, issued May 25, 1982, both of which are assigned to the same assignee as the present invention and are incorporated herein by reference as if the entire texts thereof were fully set forth herein.

OBJECTS OF THE INVENTION

An object of the present invention is to design an injection sleeve of the type described above which minimizes problems caused by freezing during the blowing of the solid material.

A further object of the present invention is to design an injection sleeve of the type described above which minimizes problems caused by clogging during the blowing of the solid materials.

Another object of the present invention is to design an injection sleeve of the type described above which minimizes problems so that the blowing process can be carried out safely.

SUMMARY OF THE INVENTION

These objectives are essentially achieved by the invention, in that the forward section of the sleeve facing the molten metal bath comprises an insulating material with a lower thermal conductivity than that of the material of the middle and rear sleeve sections.

In this manner, a freezing of the tip of the nozzle facing the molten metal bath is avoided, and a high degree of safety of the injection process is achieved, since after the end of the blowing, the molten metal bath freezes in the middle of the sleeve. These advantages are achieved by the particular material composition of the sleeve. As a result of the comparatively high insulation property of the material in the forward sleeve section, a thermal loss and therefore a freezing to the ladle bottom or to the ladle wall during the blowing process is prevented. That eliminates any danger of the nozzle clogging, and along with it the disadvantage of an undesirable interruption in the transfer of the solid materials. After the injection process is ended, on the other hand, a freezing of the returning molten metal is achieved as a result of the fact that the sleeve described by the invention has a higher thermal conductivity in the middle and rear section, and therefore leads to a higher thermal loss.

The thermal conductivity of the forward section of the sleeve is preferably less than 1 in metric units, such as watts per meter per degree Kelvin or watts per meter per degree Celsius.

The invention specifically proposes that the forward sleeve section can comprise corundum (crystalline $Al_2O_3$), for example, hollow corundum spheres.

The flow channel in the middle or rear sleeve section, in another embodiment of the invention, can be surrounded by a metal spiral or sleeve, for example, one made of copper. This further enhances the discharge of heat in the middle and rear section of the sleeve, to prevent a solidification of the molten metal which runs back into it, which takes place after every blowing operation.

In another configuration of the invention, the flow channel is bordered by an oxide ceramic tube. With the same outside diameter, the oxide ceramic tube can have different diameters, for example, between 5 mm and 20 mm, depending on the quantity of solid material to be transported.

The metal spiral or sleeve can advantageously surround this oxide ceramic tube.

Another feature of the invention proposes that the sleeve be tapered toward the forward section of the sleeve, preferably continuously and specifically in the form of a truncated cone. This shape makes the sleeve easy to install and remove for replacement.

The extraction of the sleeve after use can be further facilitated if the oxide ceramic tube is surrounded, in the middle or rear sleeve sections, over at least a portion of its length by a steel tube with a threaded section projecting out of the rear sleeve section. The threaded section can be used both for the attachment of an extraction apparatus and also for the connection of the solid material feed line.

In the embodiment described immediately above, it is particularly advantageous for the manufacture and the operational properties of the sleeve if the metal spiral or sleeve surrounds the steel tube.

The objects of the invention are formed by all the features described and/or illustrated, either individually or in any reasonable combination, independent of how they are referred to or combined in the claims.

BRIEF DESCRIPTION OF THE DRAWING

Other objectives, advantages, features and possible applications of the present invention are apparent in the following description of one embodiment with reference to the single drawing, which shows a cross section of the sleeve according to the invention.

DESCRIPTION OF THE PREFERRED EMBODIMENT

A sleeve 1 is essentially designed in the form of a truncated cone, and has a forward end *1a* and a rear end *1b*. In the illustrated embodiment, its tapered forward section 2 makes up about 1/5 of the length of the sleeve. The tapered forward section 2 preferably comprises a refractory insulating material with a thermal conductivity which is lower than that of the refractory material of a middle to rear sleeve section 3. The thermal conductivity of the forward sleeve section 2 is preferably less than 1 in metric units. A flow channel 4, which is concentric with the axis of the sleeve 1, is preferably bordered by an oxide ceramic tube 6 molded into the sleeve 1. The oxide ceramic tube 6 is flush at its forward end, towards the forward end l*a* of the sleeve 1, with the end surface of the forward sleeve section 2, while the rear end of the oxide ceramic tube 6 projects somewhat out of the end surface, at the rear end l*b*, of the middle to rear sleeve section 3. The middle to rear sleeve section 3 is made of material with comparatively good thermal conduction characteristics, especially when compared to the thermal conduction characteristics of the tapered forward section 2. In the middle to rear sleeve section 3, the oxide ceramic tube 6 is surrounded by a steel tube 7 molded into the sleeve 1. This steel tube 7 projects somewhat farther from the end surface of the rear end l*b* of the middle to rear sleeve section 3, and preferably has a threaded section 8 provided with external threads 8*a*, as illustrated. Approximately in a middle section 7*a* of the length of the steel tube 7, and overall approximately in the rear half of the middle to rear sleeve section 3, the steel tube 7 is surrounded by a metal spiral or sleeve 5, made of copper, to further enhance the thermal conductivity of this section of the steel tube 7.

The invention as described hereinabove in the context of a preferred embodiment is not to be taken as limited to all of the provided details thereof, since modifications and variations thereof may be made without departing from the spirit and scope of the invention.

What is claimed is:

1. A method for blowing solid materials into a molten metal bath through a closure section of a ladle when said ladle contains said molten metal bath, said method comprising the steps of:

providing a sleeve passing from the exterior to the interior of said closure section of said ladle, said sleeve including:

a unitary body for one piece insertion into said closure section of said ladle, said unitary body having a flow channel therein for blowing said solid materials therethrough;

said unitary body having a forward sleeve section, for facing said molten metal bath, a middle sleeve section and a rear sleeve section;

said forward sleeve section comprising an insulating material having a lower thermal conductivity than that of said middle sleeve section and also said forward sleeve section comprising an insulating material having a lower thermal conductivity than that of said rear sleeve section;

said flow channel comprising a tube disposed within said sleeve for blowing the solid materials therethrough;

metal heat conducting means immediately surrounding and contacting said tube over a substantial portion of the combination of said middle sleeve section and said rear sleeve section; and introducing said solid materials into said molten metal bath through said sleeve.

2. The method according to claim 1, wherein the thermal conductivity of at least a portion of said forward sleeve section is less than one watt per meter per degree Celsius.

3. The method according to claim 2, wherein said forward sleeve section comprises corundum.

4. The method according to claim 3, wherein said corundum comprises substantially hollow spheres of corundum.

5. The method according to claim 1, wherein said flow channel passes through at least one of said middle sleeve section and said rear sleeve sections; and wherein said flow channel is surrouded, at least at one region thereof, by heat conducting means.

6. The method according to claim 5, wherein said heat conducting means comprises a metal spiral.

7. The method according to claim 5, wherein said heat conducting means comprises a metal sleeve.

8. The method according to claim 5, wherein said heat conducting means comprises copper.

9. The method according to claim 1, wherein said tube is an oxide ceramic tube.

10. A sleeve for blowing solid materials into a molten metal bath through a closure section of a ladle when said ladle contains said molten metal bath, said sleeve comprising:

a unitary body for one piece insertion into said closure section of said ladle, said unitary body having a flow channel therein for blowing said solid materials therethrough;

said unitary body having a forward sleeve section, for facing said molten metal bath, a middle sleeve section and a rear sleeve section;

said forward sleeve section comprising an insulating material having a lower thermal conductivity than that of said middle sleeve section and also said forward sleeve section comprising an insulating material having a lower thermal conductivity than that of said rear sleeve section;

said flow channel comprising a tube disposed within said sleeve for blowing the solid materials therethrough; and metal heat conducting means immediately surrounding and contacting said tube over a substantial portion of the combination of said middle sleeve section and said rear sleeve section.

11. The sleeve according to claim 10, wherein a thermal conductivity of at least a portion of said forward sleeve section is less than one watt per meter per degree Celsius.

12. The sleeve according to claim 11, wherein said forward sleeve section comprises corundum.

13. The sleeve according to claim 12, wherein said corundum comprises substantially hollow spheres of corundum.

14. The sleeve according to claim 10, wherein said metal heat conducting means comprises a metal spiral.

15. The sleeve according to claim 10, wherein said metal heat conducting means comprises a metal sleeve.

16. The sleeve according to claim 10, wherein said metal heat conducting means comprises copper.

17. The sleeve according to claim 10, wherein said tube is an oxide ceramic tube.

18. The sleeve according to claim 17, wherein said oxide ceramic tube is surrounded along a portion thereof by said metal heat conducting means.

19. The sleeve according to claim 18, wherein said body has an outer surface which is tapered;

wherein said tapered body has a smaller end portion and a larger end portion; and wherein said smaller end portion of said tapered body is disposed at said forward sleeve section.

20. The sleeve according to claim 19, wherein said metal heat conducting means comprises a steel tube; and wherein said steel tube has a threaded section projecting out of said rear sleeve section.

21. The sleeve according to claim 18, wherein said metal heat conducting means comprises a steel tube; and wherein said steel tube has a threaded section projecting out of said rear sleeve section.

22. The sleeve according to claim 21, wherein said steel tube has a metal spiral disposed thereabout.

23. The sleeve according to claim 20, wherein said steel tube has a metal sleeve disposed thereabout.

24. The sleeve according to claim 10, wherein said body has an outer surface which is tapered;

wherein said tapered body has a smaller end portion and a larger end portion; and wherein said smaller end portion of said tapered body is disposed at said forward sleeve section.

25. The sleeve according to claim 24, wherein said body comprises a truncated cone.

26. The sleeve according to claim 25, wherein said metal heat conducting means comprises a steel tube; and wherein said steel tube has a threaded section projecting out of said rear sleeve section.

* * * * *